US010213073B2

(12) United States Patent
Feng et al.

(10) Patent No.: US 10,213,073 B2
(45) Date of Patent: Feb. 26, 2019

(54) WINDOW-CLEANING ROBOT PROVIDED WITH CLOSED WIPER

(71) Applicant: ECOVACS ROBOTICS CO., LTD., Suzhou (CN)

(72) Inventors: Linqiang Feng, Suzhou (CN); Xiaoming Lv, Suzhou (CN); Fei Zhou, Suzhou (CN)

(73) Assignee: ECOVACS ROBOTICS CO., LTD., Suzhou, Jiangsu (CN)

( * ) Notice: Subject to any disclaimer, the term of this patent is extended or adjusted under 35 U.S.C. 154(b) by 206 days.

(21) Appl. No.: 15/126,556

(22) PCT Filed: Mar. 17, 2015

(86) PCT No.: PCT/CN2015/074385
§ 371 (c)(1),
(2) Date: Sep. 15, 2016

(87) PCT Pub. No.: WO2015/139613
PCT Pub. Date: Sep. 24, 2015

(65) Prior Publication Data

US 2017/0079487 A1 Mar. 23, 2017

(30) Foreign Application Priority Data

Mar. 17, 2014 (CN) ..... 2014 1 0098719

(51) Int. Cl.
*A47L 1/02* (2006.01)

(52) U.S. Cl.
CPC ..... *A47L 1/02* (2013.01); *A47L 2201/00* (2013.01)

(58) Field of Classification Search
CPC ..... A47L 1/02; A47L 1/03; A47L 11/4077; A47L 11/4044
See application file for complete search history.

(56) References Cited

U.S. PATENT DOCUMENTS 4,805,256 A * 2/1989 Mason ..... A47L 11/283 15/320
8,099,818 B2 * 1/2012 Miyake ..... A47L 1/02 15/103

(Continued)

FOREIGN PATENT DOCUMENTS

CN 2331306 Y 8/1999
CN 2404476 Y 11/2000

(Continued)

OTHER PUBLICATIONS

Machine-generated English translation of DE 102012110387 A1, Apr. 2014, Strang et al.*

(Continued)

*Primary Examiner* — Laura C Guidotti
(74) *Attorney, Agent, or Firm* — Timothy S. Westby; Porter Hedges LLP

(57) ABSTRACT

A window-cleaning robot provided with a closed wiper (13), comprising a rotating base (10) and an outer frame (20); said rotating base (10) being rotatably disposed on the outer frame (20); the bottom of said outer frame (20) being provided with a cleaning unit (21); said rotating base (10) being provided with a travel unit (11) and a suction cup (12); the bottom surface of the rotating base (10) also being provided with a wiper (13); said wiper (13) being disposed on the bottom surface such that the wiper (13) surrounds the rotating base (10) in a closed shape; the travel unit (11) and/or the suction cup (12) being enclosed within said closed shape. The wiper (13) is entirely closed such that regardless of where the robot travels, 360° wiping can be accomplished, effectively preventing the travel unit (11) and the suction cup (12) from becoming wet, resulting in more effective wiping and effectively preventing slippage.

13 Claims, 3 Drawing Sheets

(56) References Cited

U.S. PATENT DOCUMENTS

| | | | |
|---|---|---|---|
| 2003/0066160 | A1 | 4/2003 | Meller |
| 2015/0251318 | A1 | 9/2015 | Lv |

FOREIGN PATENT DOCUMENTS

| | | | | | |
|---|---|---|---|---|---|
| CN | 2486096 | Y | | 4/2002 | |
| CN | 1448103 | A | | 10/2003 | |
| CN | 2877537 | Y | | 3/2007 | |
| CN | 103565344 | | | 2/2014 | |
| CN | 103565344 | A | | 2/2014 | |
| CN | 203802383 | U | | 9/2014 | |
| DE | 102012110387 | A1 | * | 4/2014 | ..... A47L 1/02 |
| EP | 0574023 | A1 | | 12/1993 | |
| EP | 2462855 | | | 6/2012 | |
| KR | 20120009927 | A | | 2/2012 | |
| WO | 2008087096 | | | 7/2008 | |

OTHER PUBLICATIONS

Search Report dated May 28, 2015 for corresponding International Application No. PCT/CN2015/074385, (6 pgs.).
Office Action dated Nov. 7, 2016 for Chinese Patent Application No. 201410098719.3 (6 pgs.).
Extended European Search Report dated Nov. 9, 2017 issued for corresponding European Patent Application No. 15764648.0 (7 pgs.).

* cited by examiner

WINDOW-CLEANING ROBOT PROVIDED WITH CLOSED WIPER

FIELD OF THE INVENTION

The present invention relates to a window-cleaning robot provided with a closed wiper and belongs to the technical field of small household appliances manufacture.

BACKGROUND OF THE PRIOR ART

With widely using of window-cleaning robots in household, whether the window-cleaning robot walks normally on the window will directly affect its window-cleaning result. The robot can walks normally only on the premise of skid resistance. FIG. 1 is a schematic figure of the structure of the elongated shape wiper of the window-cleaning robot according to the prior art. As shown in FIG. 1, a seat 200 of a window-cleaning robot 100 according to the prior art is provided with a drive wheel 300 and a suction cup 400. Typically, the seat 200 is also provided with an elongated silicone strip 500 used to wipe off water on the glass so as to prevent the drive wheel 300 from slipping due to contacting with the water and to prevent the suction cup 400 from getting wet by the water. Since the silicone strip according to the prior art is of an elongated shape structure, it can only effectively wipe off water in one direction (i.e., in the direction perpendicular to the direction along which the elongated shape structure is disposed), and if the window-cleaning robot revolves to the direction parallel to the direction along which the elongated structure is disposed, the robot cannot wipe off water and thus the drive wheel 300 may slip due to contacting with the water.

SUMMARY OF THE INVENTION

In view of the above technical problems in the prior art, the present invention intends to provide a window-cleaning robot provided with a closed wiper, which is configured to be entirely closed, such that when the robot is adsorbed onto the window, the closed wiper is pressed tightly and separates the inner side thereof from the outer side. Thus, regardless of how the robot travels, the closed wiper can carry out 360° wiping, and the water from any direction can be kept outside by the wiper and cannot enter into the inner side of the wiper, effectively preventing the drive wheel and the suction cup from getting wet, resulting in more effective wiping and effectively preventing the robot from slipping.

The technical problems of the present invention are solved through technical solutions as follows.

A window-cleaning robot provided with a closed wiper, comprising a rotating base and an outer frame; the rotating base being rotatably disposed on the outer frame; the bottom of the outer frame being provided with a cleaning unit; the rotating base being provided with a travel unit and a suction cup; the bottom surface of the rotating base being provided with a wiper; the wiper being disposed in a closed shape on the bottom surface of the rotating base; the travel unit and/or the suction cup being enclosed within the closed shape.

In order to ensure that the wiper isolates the inner side thereof from the outer side, the height of the wiper is larger than the height of the travel unit.

In order to facilitate arranging, the wiper either may be of one entirely closed shape, or may be divided into a plurality of entirely closed shapes. For example, the wiper may have a first wiper and a second wiper. The first wiper encloses the outer circumference of the travel unit and the second wiper encloses the outer circumference of the suction cup.

As needed, the travel unit is a roller wheel or a crawler travel mechanism.

The first wiper and the second wiper each are plural, the numbers of which correspond to the numbers of the travel unit and the suction cup.

In order to ensure the effect of skid resistance, the wiper is higher than the travel unit by 0.01 mm to 1 mm.

In order to facilitate connecting and fixing, the rotating base is provided with a groove, protruding plates are provided on the sidewalls of the groove, both sides of a fixed end of the wiper are formed with concave slots, and the protruding plates snap into and engage with the concave slots.

The suction cup communicates with a vacuum pump through a hose, and the vacuum pump operates to establish a negative pressure within the suction cup so that the window-cleaning robot is adsorbed onto a work surface.

In order to facilitate turning, the outer frame is square.

From the above, the wiper of the present invention is entirely closed such that when the robot is adsorbed onto the window, the closed wiper is pressed tightly and isolates the inner side thereof from the outer side. Thus, regardless of how the robot travels, the closed wiper can carry out 360° wiping, and the water from any direction can be kept outside by the wiper and cannot enter into the inner side of the wiper, effectively preventing the drive wheel and the suction cup from getting wet, resulting in more effective wiping and effectively preventing the robot from slipping or the suction cup from being contaminated by water stain.

Hereinafter the technical solutions of the present invention will be described in detail in combination with attached drawings and specific embodiments.

DESCRIPTION OF ATTACHED DRAWINGS

DETAILED DESCRIPTION OF PREFERRED EMBODIMENTS

The First Embodiment

Figure 1:
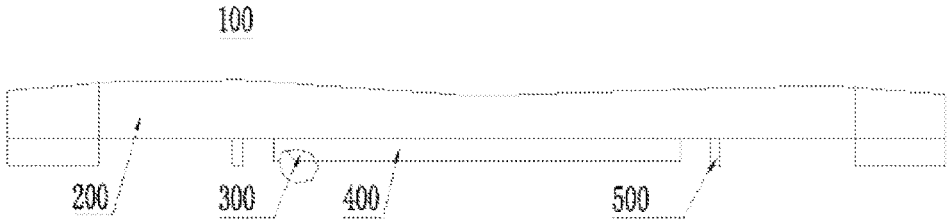
Fig. 1 (Prior Art)
FIG. 1 is a schematic figure of the structure of the elongated shape wiper of the window-cleaning robot according to the prior art.
Figure 2:
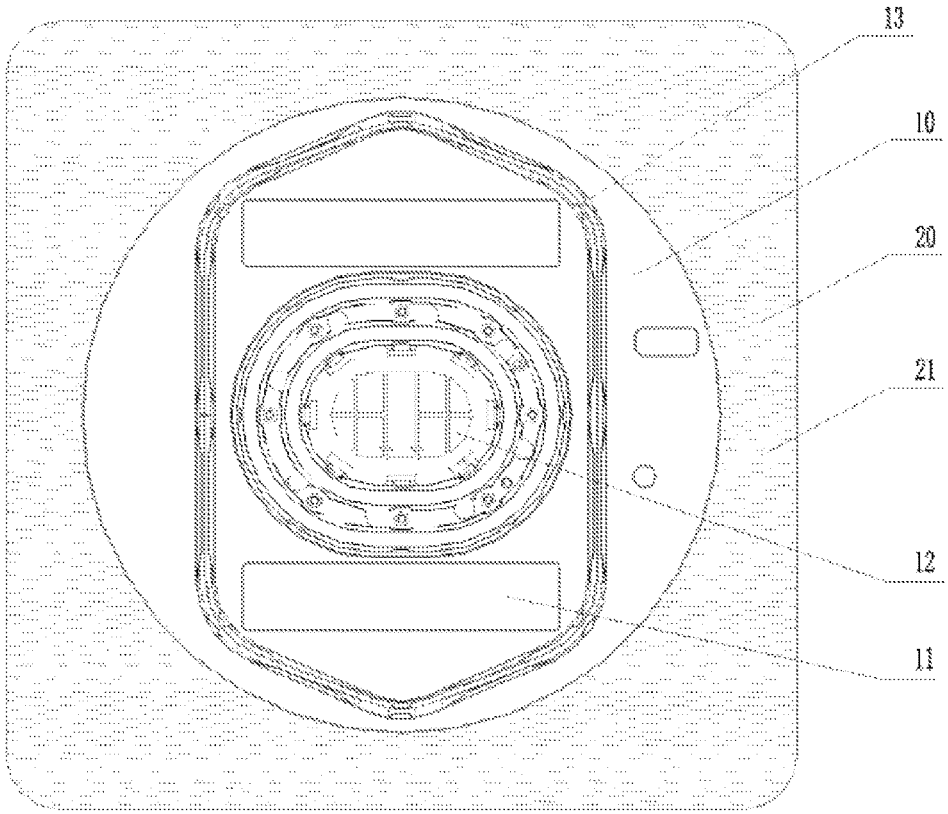
FIG. 2 is a schematic figure of the bottom structure of the robot body according to the first embodiment of the present invention.

FIG. 2 is a schematic figure of the bottom structure of the robot body according to the first embodiment of the present invention. As shown in FIG. 2, the present invention provides a window-cleaning robot provided with a closed wiper comprising a rotating base 10 and an outer frame 20. The rotating base 10 may be rotatably provided onto the outer frame 20. The outer frame 20 is square (but not limited to being square and it can be set to be of other shapes according to the need of cleaning work surface). The bottom of the outer frame 20 is provided with a cleaning unit 21 such as a cleaning cloth. The rotating base 10 is provided with a travel unit 11 and a suction cup 12, and a wiper 13 is provided in a closed shape on the bottom surface of the rotating base. In order to ensure that the wiper separates the inner side thereof from the outer side, the height of the wiper 13 is larger than the height of the travel unit 11. Furthermore, in order to ensure the effect of skid resistance, the wiper 13 is higher than the travel unit 11 by 0.01 mm to 1 mm. However, when the window-cleaning robot is adsorbed onto the work surface, the wiper 13, the travel unit 11 and the suction cup 12 is at the same level in height, i.e., all of them contact with the work surface. As needed, the travel unit 11 may be a roller wheel or a crawler travel mechanism. The suction cup 12 communicates with a vacuum pump through a hose. The vacuum pump operates to establish a negative pressure within the suction cup so that the window-cleaning robot is adsorbed onto the work surface.

Figure 3:
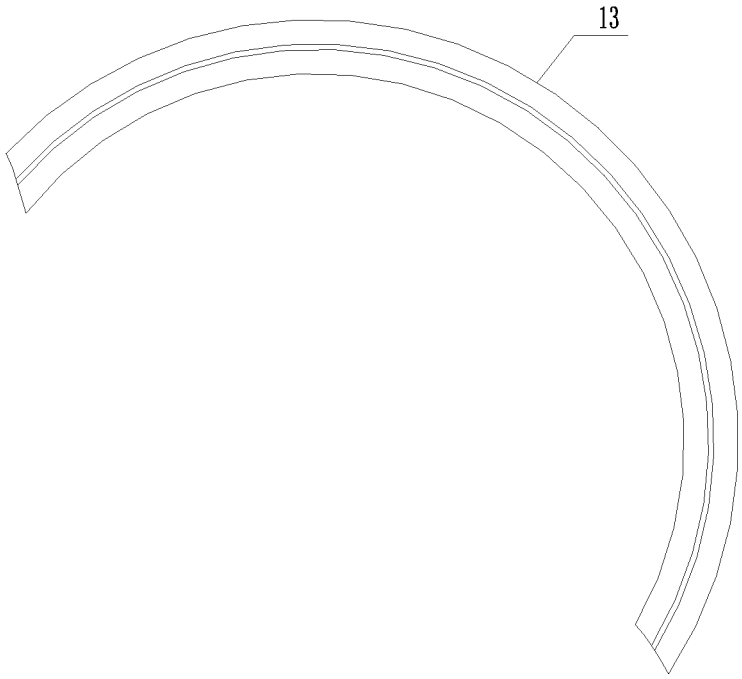
FIG. 3 is a schematic figure of the partial structure of the wiper according to the present invention.
Figure 4:
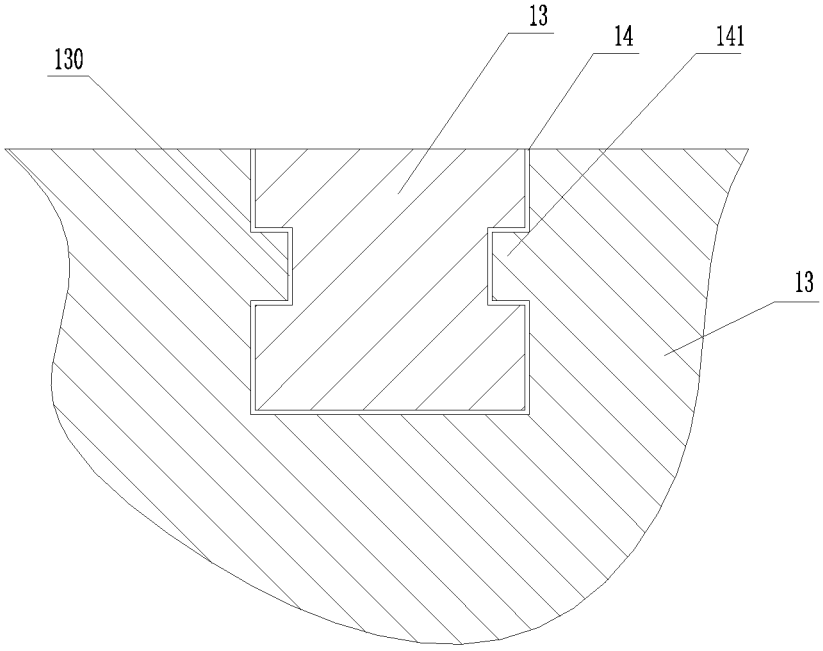
FIG. 4 is a schematic figure of the connection structure between the wiper and a rotating base.

FIG. 3 is a schematic figure of the structure of the wiper according to the present invention, and FIG. 4 is a schematic figure of the connection structure between the wiper and the rotating base. An shown in FIG. 3 in combination with FIG. 4, in order to facilitate connecting and fixing, the rotating base 10 is provided with a groove 14 having protruding plates 141 on the sidewalls thereof, and both sides of the fixed end of the wiper 13 are provided with concave slots 130, and the protruding plates 141 snap into and engage with the concave slots 130.

In combination with FIG. 2, the wiper 13 is formed as an entirely closed shape such that the travel unit 11 and the suction cup 12 are entirely enclosed within the closed shape so as to be isolated from the external space of the wiper 13. When the window-cleaning robot starts to operate, its travel mode includes a straight travel mode and a spot turn mode. Specifically, the window-cleaning robot operates along the direction of an frame edge of the glass under the straight travel mode; and when the window-cleaning robot meets a vertex angle of the glass, the rotating base is able to make a spot turn relative to the frame edge, and then returns to the state of straight traveling. In the above movement, since the travel unit 11 and the suction cup 12 are enclosed within a closed space by the wiper 13, stains, water scales and the like on the work surface can be isolated from the inner side of the closed wiper 13 by the closed wiper 13 regardless of the direction they meet, having no affect on the travel unit 11 and the suction cup 12.

The Second Embodiment

Figure 5:
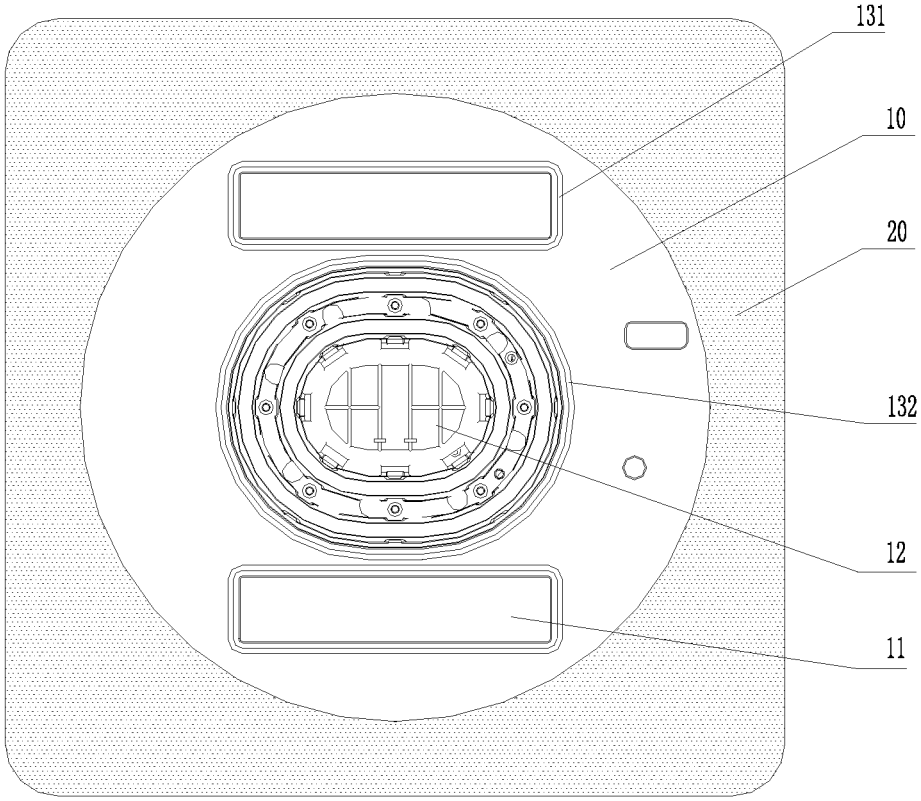
FIG. 5 is a schematic figure of the bottom structure of the robot body according to the second embodiment of the present invention.

FIG. 5 is a schematic figure of the bottom structure of the robot body according to the second embodiment of the present invention. In order to facilitate arranging, the wiper either may be of one entirely closed shape as described in the first embodiment, or may be divided into a plurality of entirely closed shapes. For example, the wiper 13 may have a first wiper 131 and a second wiper 132 as shown in FIG. 5. The first wiper 131 encloses the outer circumference of the travel unit 11 and the second wiper 132 encloses the outer circumference of the suction cup 12. Of course, The first wiper and the second wiper each may be plural, the numbers of which correspond to the numbers of the travel unit and the suction cup. Obviously, in the present embodiment, the travel unit 11 and the suction cup 12 are enclosed by the wiper like in the first embodiment; and the difference from the first embodiment is in that the travel unit 11 and the suction cup 12 are enclosed separately.

The travel unit and the suction cup are enclosed in both of the above-mentioned embodiments of the present invention. However, in actual use, the effect of preventing the robot from slipping can be achieved by only enclosing the travel unit, and the effect of preventing the suction cup from being contaminated by water stains can be achieved by only enclosing the suction cup. From the above, the wiper of the present invention is configured to be entirely closed such that when the robot is adsorbed onto the window, due to the entirely closed structure and the height of the wiper, which is larger than the height of the travel unit, the wiper is pressed tightly and isolates the closed inner side from the outer side when the window-cleaning robot is adsorbed onto the window surface. Thus, regardless of how the window-cleaning robot travels, the closed wiper can carry out 360° wiping, and thus the water from any direction can be kept outside by the wiper and cannot enter into the inner side of the wiper to wet the travel unit 11 and the suction cup 12, resulting in more effective wiping and effectively preventing the robot from slipping or preventing the suction cup from contaminated by water stain.

The invention claimed is:

1. A window-cleaning robot provided with a closed wiper, comprising a rotating base (10) and an outer frame (20); the rotating base being rotatably disposed on the outer frame; the bottom of the outer frame being provided with a cleaning unit (21); the rotating base being provided with a travel unit (11) and a suction cup (12); the bottom surface of the rotating base being provided with a wiper (13), characterized in that, the wiper (13) is provided in a closed shape on the bottom surface of the rotating base; and the travel unit (11) and/or the suction cup (12) are enclosed within the closed shape.

2. The window-cleaning robot of claim 1, characterized in that, the height of the wiper (13) is larger than the height of the travel unit (11).

3. The window-cleaning robot of claim 2, characterized in that, the wiper (13) has a first wiper (131) and a second wiper (132), wherein the first wiper (131) encloses the outer circumference of the travel unit (11) and the second wiper (132) encloses the outer circumference of the suction cup (12).

4. The window-cleaning robot of claim 3, characterized in that, the wiper (13) is higher than the travel unit (11) by 0.01 mm to 1 mm.

5. The window-cleaning robot of claim 3, characterized in that, the travel unit (11) is a roller wheel or a crawler travel mechanism.

6. The window-cleaning robot of claim 5, characterized in that, the first wiper (131) and the second wiper (132) each are plural, the numbers of which correspond to the numbers of the travel unit (11) and the suction cup (12).

7. The window-cleaning robot of claim 6, characterized in that, the wiper (13) is higher than the travel unit (11) by 0.01 mm to 1 mm.

8. The window-cleaning robot of claim 5, characterized in that, the wiper (13) is higher than the travel unit (11) by 0.01 mm to 1 mm.

9. The window-cleaning robot of claim 2, characterized in that, the wiper (13) is higher than the travel unit (11) by 0.01 mm to 1 mm.

10. The window-cleaning robot of claim 1, characterized in that, the wiper (13) is higher than the travel unit (11) by 0.01 mm to 1 mm.

11. The window-cleaning robot of claim 1, characterized in that, the rotating base (10) is provided with a groove (14), protruding plates (141) are provided on the sidewalls of the groove, both sides of a fixed end of the wiper (13) are provided with concave slots (130), and the protruding plates (141) snap into and engage with the concave slots (130).

12. The window-cleaning robot of claim 1, characterized in that, the suction cup (12) communicates with a vacuum pump through a hose, and the vacuum pump operates to establish a negative pressure within the suction cup so that the window-cleaning robot is adsorbed onto a work surface.

13. The window-cleaning robot of claim 1, characterized in that, the outer frame (20) is square.

* * * * *